US007918985B2

(12) United States Patent
Strezov et al.

(10) Patent No.: US 7,918,985 B2
(45) **Date of Patent: *Apr. 5, 2011**

(54) REDUCTION OF METAL OXIDES IN AN ELECTROLYTIC CELL

(75) Inventors: Les Strezov, Adamstown (AU); Ivan Ratchev, Georgetown (AU); Steve Osborn, Valentine (AU)

(73) Assignee: Metalysis Limited, Rotherham (GB)

( * ) Notice: Subject to any disclaimer, the term of this patent is extended or adjusted under 35 U.S.C. 154(b) by 778 days.

This patent is subject to a terminal disclaimer.

(21) Appl. No.: 10/482,055

(22) PCT Filed: Jun. 28, 2002

(86) PCT No.: PCT/AU02/00843

§ 371 (c)(1),
(2), (4) Date: May 4, 2004

(87) PCT Pub. No.: WO03/002785

PCT Pub. Date: Jan. 9, 2003

(65) Prior Publication Data

US 2004/0173470 A1 Sep. 9, 2004

(30) Foreign Application Priority Data

Jun. 29, 2001 (AU) ..... PR6029

(51) Int. Cl.
*C25C 3/28* (2006.01)

(52) U.S. Cl. ..... 205/398; 205/401

(58) Field of Classification Search ..... 205/46, 205/47

See application file for complete search history.

(56) References Cited

U.S. PATENT DOCUMENTS

| | | | | |
|---|---|---|---|---|
| 3,728,244 | A | 4/1973 | Cooley | |
| 4,036,705 | A | 7/1977 | Eidschun, Jr. | |
| 4,124,454 | A | 11/1978 | Shang | |
| 4,132,618 | A | 1/1979 | Boulange et al. | |
| 4,225,395 | A | 9/1980 | Tsang | |
| 4,381,976 | A | 5/1983 | Armand | |
| 4,430,166 | A | 2/1984 | Carter | |
| 4,518,426 | A | 5/1985 | Murphy | |
| 4,772,361 | A | 9/1988 | Dorsett et al. | |
| 5,151,169 | A | 9/1992 | Galyon et al. | |
| 5,279,715 | A * | 1/1994 | La Camera et al. | 205/373 |
| 6,299,742 | B1 | 10/2001 | Pal et al. | |
| 6,540,902 | B1 | 4/2003 | Redey et al. | |
| 6,663,763 | B2 * | 12/2003 | Strezov et al. | 205/367 |
| 6,712,952 | B1 * | 3/2004 | Fray et al. | 205/640 |

FOREIGN PATENT DOCUMENTS

| | | |
|---|---|---|
| DE | 150557 | 6/1903 |
| GB | 2 359 564 A | 8/2001 |
| WO | WO 93/05203 | 3/1993 |
| WO | WO 99/64638 | 12/1999 |
| WO | WO 01/62994 A1 | 8/2001 |

OTHER PUBLICATIONS

Ono et al. "A New Concept for Producing Ti Sponge: Calciothermic Reduction," JOM. New York: Feb. 2002. vol. 54, Iss. 2; p. 59, 3pgs.*
Ono et al. "Electrochemical Deoxidation of Titanium," Metallurgical Transactions B. Jun. 1993. vol. 24B pp. 449-455.*
Okabe et al. "Electrochemical Deoxidation of Yttrium-Oxygen Solid Solutions," Journal of Alloys and Compounds 237 (1996). pp. 1509-154.*
Ferro et al. Application of Ceramic Membrane in Molten Salt Electrolysis of CaO-CaCl2. Waste Management (1997). vol. 17, No. 7, pp. 451-461.*
"Studies in the Electrolytic Reduction of Titanium Dioxide and Titanium Slag", S. Takeuchi et al. Nippon Kinzoku Gakkaishi, vol. 28, No. 9, pp. 549-554 (circa 1964) (no month).
"Reduction of Titanium Dioxide by Calcium in Hot Cathode Spot", Oki et al., Memoirs of the School of Engineering, Nagoya University, vol. 19, No. 1 (1967) (no month).

* cited by examiner

*Primary Examiner* — Harry D Wilkins, III
(74) *Attorney, Agent, or Firm* — Miles & Stockbridge, P.C.; David R. Schaffer, Esq.

(57) ABSTRACT

A method of reducing a titanium oxide in a solid state in an electrolytic cell which includes an anode, a cathode formed at least in part from the titanium oxide, and a molten electrolyte which includes cations of a metal that is capable of chemically reducing the cathode titanium oxide, which method includes operating the cell at a potential that is above a potential at which cations of the metal that is capable of chemically reducing the cathode titanium oxide deposit as the metal on the cathode, whereby the metal chemically reduces the cathode titanium oxide, and which method is characterized by refreshing the electrolyte and/or changing the cell potential in later stages of the operation of the cell as required having regard to the reactions occurring in the cell and the concentration of oxygen in the titanium oxide in the cell in order to produce high purity titanium.

9 Claims, 1 Drawing Sheet

REDUCTION OF METAL OXIDES IN AN ELECTROLYTIC CELL

FIELD OF THE INVENTION

The present invention relates to reduction of metal oxides in an electrolytic cell.

The present invention was made during the course of an on-going research project on the electrolytic reduction of titania ($TiO_2$) carried out by the applicant.

During the course of the research project the applicant carried out experimental work on an electrolytic cell that included a graphite crucible that formed an anode of the cell, a pool of molten $CaCl_2$-based electrolyte in the crucible, and a cathode that included solid titania.

BACKGROUND OF THE INVENTION

One objective of the experimental work was to reproduce the results reported in International application PCT/GB99/01781 (Publication no. WO99/64638) in the name of Cambridge University Technical Services Limited and in technical papers published by the inventors.

The Cambridge International application discloses two potential applications of a discovery in the field of metallurgical electrochemistry.

One application is the direct production of a metal from a metal oxide.

In the context of this application, the "discovery" is the realisation that an electrolytic cell can be used to ionize oxygen contained in a metal oxide so that the oxygen dissolves in an electrolyte. The Cambridge International application discloses that when a suitable potential is applied to an electrolytic cell with a metal oxide as a cathode, a reaction occurs whereby oxygen is ionised and is subsequently able to dissolve in the electrolyte of the cell.

European patent application 9995507.1 derived from the Cambridge International application has been allowed by the European Patent Office.

The allowed claims of the European patent application inter alia define a method of electrolytically reducing a metal oxide (such as titania) that includes operating an electrolytic cell at a potential that is lower than the deposition potential of cations in the electrolyte.

The Cambridge European patent application does not define what is meant by deposition potential and does not include any specific examples that provide values of the deposition potential for particular cations.

However, submissions dated 2 Oct. 2001 to the European Patent Office by the Cambridge patent attorneys, which predated the lodgement of the claims that were ultimately allowed, indicate that they believe that the decomposition potential of an electrolyte is the deposition potential of a cation in the electrolyte.

Specifically, page 5 of the submissions state that:

"The second advantage described above is achieved in part through carrying out the claimed invention below the decomposition potential of the electrolyte. If higher potentials are used then, as noted in D1 and D2, the cation in the electrolyte deposits on the metal or semi-metal compound. In the example of D1, this leads to calcium deposition and therefore consumption of thin reactive metal . . . During operation of the method, the electrolytic cation is not deposited on the cathode".

BRIEF DESCRIPTION OF THE INVENTION

Contrary to the findings of Cambridge, the experimental work carried out by the applicant has established that it is essential that the electrolytic cell be operated at a potential that is above the potential at which $Ca^{++}$ cations in the electrolyte can deposit as Ca metal on the cathode.

Specifically, as a consequence of the experimental work, the applicant has invented a method of reducing a metal oxide such as titanium oxides in a solid state in an electrolytic cell which includes an anode, a cathode formed at least in part from the metal oxide, and a molten electrolyte which includes cations of a metal that is capable of chemically reducing the cathode metal oxide, which method includes a step of operating the cell at a potential that is above a potential at which cations of the metal that is capable of chemically reducing the cathode metal oxide deposit as the metal on the cathode, whereby the metal chemically reduces the cathode metal oxide.

The above method is described in Australian provisional application PS3049 in the name of the applicant lodged on 20 Jun. 2002, and the disclosure in the patent specification lodged with the application is incorporated herein by cross-reference.

In addition to the above, the experimental work (and associated theoretical analysis work) carried out by the applicant has determined a number of important factors that play a role in the actual reduction process.

DETAILED DESCRIPTION OF THE INVENTION

Figure 1:
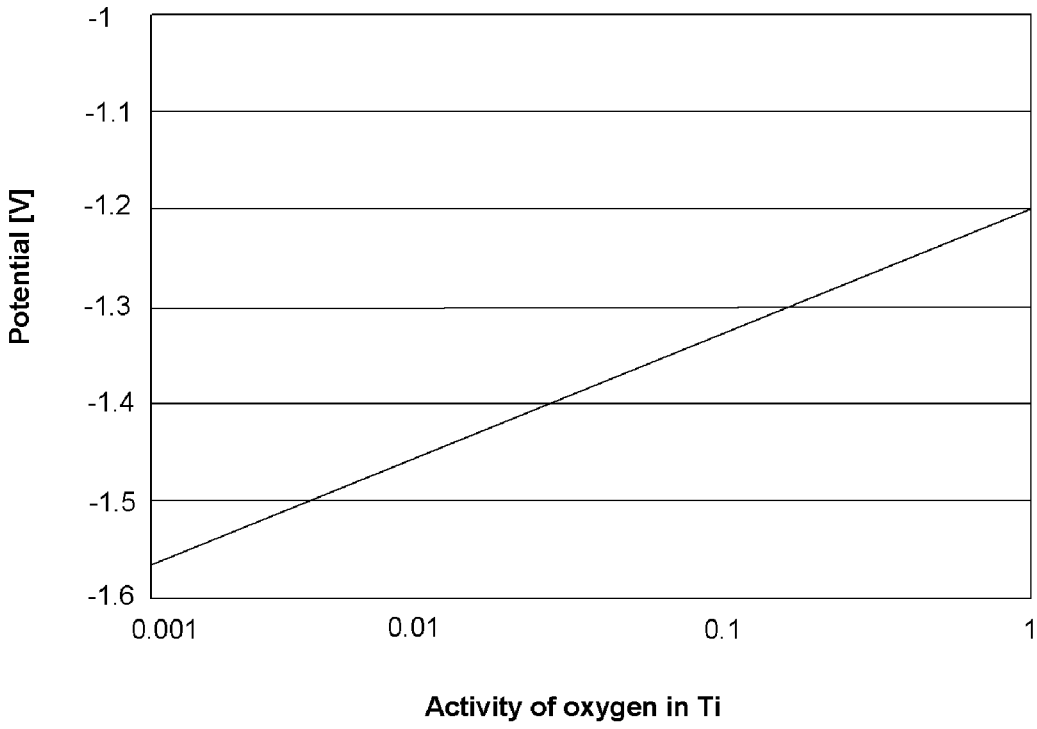
FIG. 1 is a graph illustrating the variation of potential with the concentration of oxygen in titanium.

The relevant experimental data indicates that (i) $Cl_2$ gas is removed at the anode of the electrolytic cell at potentials well below the theoretical decomposition potential of the electrolyte $CaCl_2$, (ii) $Ca_XTi_YO_Z$, is present at the cathode during some stages of the electrolysis, and (iii) CaO is formed in the molten electrolyte bath.

In view of the above, the applicant has concluded that a number of steps are involved in the method of reducing titanium oxides and that some of these steps are represented by reactions (1) to (8) mentioned below. Reactions (1) to (8) relate to reduction of titanium oxides using an electrolytic cell with $CaCl_2$ (containing O anions) as the electrolyte and a graphite anode, with their standard potentials at 950° C.

$$CaCl_2+3TiO_2=CaTiO_3+Cl_2(g)+Ti_2O_3 \quad (1)$$

$E^\circ_{950C}=-1.45$ V $$CaCl_2+2TiO_2=CaTiO_3+Cl_2(g)+TiO \quad (2)$$

$E^\circ_{950C}=-1.63$ V $$CaCl_2+0.5TiO_2=CaO+Cl_2(g)+0.5Ti \quad (3)$$

$E^\circ_{950C}=-2.4$ V $$CaTiO_3+C=CaO+TiO+CO(g) \quad (4)$$

$E^\circ_{950C}=-0.86$ V $$CaTiO_3+2C=CaO+Ti+2CO(g) \quad (5)$$

$E^\circ_{950C}=-0.96$ V $$Ti_2O_3+C=2TiO+CO(g) \quad (6)$$

$E^\circ_{950C}=-0.58$ V $$TiO+C=Ti+CO(g) \quad (7)$$

$E^\circ_{950C}=-1.07$ V $$[O]Ti+C=CO(gas) \quad (8)$$

Reactions (1) to (8) are not an exhaustive list, of the possible reaction and other reactions can take place. Specifically, the applicant suspects that other reactions, involving titanium suboxides, represented by the formula $Ti_nO_{2n-1}$, and calcium titanates, represented by the formula $CaTi_nO_{3n+1}$, can take place.

The potential of reaction (8) in particular varies with the concentration of oxygen in titanium. The following graph illustrates the variation of potential with concentration of oxygen in titanium in a cell operating at 950° C. The graph was prepared by the applicant using published data.

It is clear from the graph that reaction (8) requires higher potentials at lower concentrations of oxygen and thus there is increased resistance to oxygen removal as the oxygen concentration decreases.

The solubility of different titanium oxides in $CaCl_2$ is not taken into consideration in the calculation of the potentials for reactions (1) to (8). The significance of this is that some of reactions (1) to (8) may take place at potentials that are higher or lower than the potentials stated above at the stated temperature of 950° C.

For example, reduced activity of TiO will reduce the value of the potentials of reactions (2), (4) and (6) (i.e. make the potentials more positive) and at the same time will increase the potential of reaction (7) (i.e. make it more negative).

In view of the above, the applicant has realised that it is likely to be extremely difficult to reduce titanium oxide in an electrolytic cell to titanium ($\alpha$Ti) of high purity, i.e. low concentration of oxygen (no more than 100 ppm oxygen) in a single stage operation.

Specifically, the applicant has realised that it is necessary to refresh the electrolyte and/or to change cell potential in a later stage or in later stages of the operation of the electrolytic cell in order to reduce titanium oxide in an electrolytic cell to $\alpha$ titanium of high purity, ie low concentration of oxygen.

According to the present invention there is provided a method of reducing a titanium oxide in a solid state in an electrolytic cell which includes an anode, a cathode formed at least in part from the titanium oxide, and a molten electrolyte which includes cations of a metal that is capable of chemically reducing the cathode titanium oxide, which method includes operating the cell at a potential that is above a potential at which cations of the metal that is capable of chemically reducing the cathode titanium oxide deposit as the metal on the cathode, whereby the metal chemically reduces the cathode titanium oxide, and which method is characterised by refreshing the electrolyte and/or changing the cell potential in later stages of the operation of the cell as required having regard to the reactions occurring in the cell and the concentration of oxygen in the titanium oxides in the cell in order to produce high purity titanium ($\alpha$Ti).

The term "high purity" is understood to mean that the concentration of oxygen is no more than 100 ppm in the titanium.

In effect, the present invention is concerned with selecting the operating conditions of the cell, including cell potential and/or electrolyte composition, during various stages of the operation in the cell having regard to the reactions that take place in the cell. The applicant envisages at this stage that commercial operations will be at constant currant and that it may not be possible to achieve voltages required to remove oxygen to very low levels because of composition changes in the electrolyte. In these circumstances, refreshing and or changing the electrolyte composition is important in order to produce a high purity $\alpha$ titanium.

The above-described method makes it possible to produce titanium of high purity with respect to oxygen in an electrolytic cell and without refining or otherwise processing the titanium outside the electrolytic cell.

The method may include refreshing the electrolyte by adding new electrolyte to the existing electrolyte or otherwise adjusting the composition of the electrolyte.

In addition, the method may include carrying out the method in a series of electrolytic cell and successively transferring the partially reduced titanium oxide to each of the cells in the series.

The composition of the electrolyte in each cell may be selected having regard to the reactions occurring in the cell and the concentration of oxygen in the titanium oxide in the cell.

The cell potential may be changed at different stages in the method on a continuous or a step-change basis.

Preferably the metal deposited on the cathode is soluble in the electrolyte and can dissolve in the electrolyte and thereby migrate to the vicinity of the cathode titanium oxide.

It is preferred that the electrolyte be a $CaCl_2$-based electrolyte that includes CaO as one of the constituents of the electrolyte.

In such a situation it is preferred that the cell potential be above the potential at which Ca metal can deposit on the cathode, i.e. the decomposition potential of CaO.

The decomposition potential of CaO can vary over a considerable range depending on factors such as the composition of the anode, the electrolyte temperature and electrolyte composition.

In a cell containing CaO saturated $CaCl_2$ at 1373K (1100° C.) and a graphite anode this would require a minimum cell potential of 1.34V.

It is also preferred that the cell potential be below the decomposition potential of $CaCl_2$.

In a cell containing CaO saturated $CaCl_2$ at 1373K (1100° C.) and a graphite anode this would reqtuire that the cell potential be less than 3.5V.

The decomposition potential of $CaCl_2$ can vary over a considerable range depending on factors such as the composition of the anode, the electrolyte temperature and electrolyte composition.

For example, a salt containing 80% $CaCl_2$ and 20% KCl at a temperature of 900K (657° C.), decomposes to Ca (metal) and $Cl_2$ (gas) above 3.4V and a salt containing 100% $CaCl_2$ at 1373K (1100° C.) decomposes at 3.0V.

In general terms, in a cell containing CaO—$CaCl_2$ salt (not saturated) at a temperature in the range of 600-1100° C. and a graphite anode it is preferred that the cell potential be between 1.3 and 3.5V.

The $CaCl_2$-based electrolyte may be a commercially available source of $CaCl_2$, such as calcium chloride dihydrate, that partially decomposes on heating and produces CaO or otherwise includes CaO.

Alternatively, or in addition, the $CaCl_2$-based electrolyte may include $CaCl_2$ and CaO that are added separately or pre-mixed to form the electrolyte.

It is preferred that the anode be graphite or an inert anode.

The cell may be of the type disclosed in the drawings of the patent specification lodged with Australian provisional application PS3049.

The invention claimed is:

1. A method of reducing a titanium oxide in a solid state in an electrolytic cell which includes an anode, a cathode formed at least in-part from the titanium oxide, and a molten electrolyte which includes cations of a metal that is capable of chemically reducing the cathode titanium oxide, said method includes:

operating the cell at a potential that is above a potential at which cations of the metal that is capable of chemically reducing the cathode titanium oxide deposit as the metal on the cathode, whereby the metal chemically reduces the cathode titanium oxide, and refreshing the electrolyte within the cell and changing the cell potential of the cell in later stages of the operation of the cell as required having regard to reactions occurring in the cell and a concentration of oxygen in the titanium oxide in the cell in order to produce high purity titanium ($\alpha$Ti).

2. The method defined in claim 1 wherein the metal deposited on the cathode is soluble in the electrolyte and can dissolve in the electrolyte and thereby migrate to the vicinity of the cathode titanium oxide.

3. The method defined in claim 1 wherein the electrolyte is a $CaCl_2$-based electrolyte that includes CaO as one of a plurality of constituents of the electrolyte.

4. The method defined in claim 3 wherein the cell potential is above a decomposition potential of CaO, at which potential Ca metal can deposit on the cathode.

5. The method defined in claim 3 wherein the cell potential is below the decomposition potential of $CaCl_2$.

6. The method defined in claim 3 wherein a graphite anode is employed, and said cell is operated at a temperature in the range of 600-1100° C., with the cell potential being between 1.3 and 3.5V.

7. The method defined in claim 3 wherein the $CaCl_2$-based electrolyte is a commercially available source of $CaCl_2$ that partially decomposes on heating and produces CaO or otherwise includes CaO.

8. The method defined in claim 3 wherein the $CaCl_2$-based electrolyte includes $CaCl_2$ and CaO that are added separately or pre-mixed to form the electrolyte.

9. The method defined in claim 1 wherein the anode is graphite or an inert anode.

* * * * *